US009022254B2

(12) United States Patent
Chen et al.

(10) Patent No.: US 9,022,254 B2
(45) Date of Patent: May 5, 2015

(54) VENDING MACHINE WITH DISPENSING ASSEMBLY

(71) Applicants: Hong Fu Jin Precision Industry (WuHan) Co., Ltd., Wuhan (CN); Hon Hai Precision Industry Co., Ltd., New Taipei (TW)

(72) Inventors: Yun-Lung Chen, New Taipei (TW); Zhi-Jun Fu, Wuhan (CN)

(73) Assignees: Hong Fu Jin Precision Industry (WuHan) Co., Ltd., Wuhan (CN); Hon Hai Precision Industry Co., Ltd., New Taipei (TW)

( * ) Notice: Subject to any disclaimer, the term of this patent is extended or adjusted under 35 U.S.C. 154(b) by 109 days.

(21) Appl. No.: 13/947,758

(22) Filed: Jul. 22, 2013

(65) Prior Publication Data

US 2014/0158706 A1 Jun. 12, 2014

(30) Foreign Application Priority Data

Dec. 11, 2012 (CN) ..... 2012 1 0530036

(51) Int. Cl.
*A47F 1/04* (2006.01)
*G07F 11/42* (2006.01)

(52) U.S. Cl.
CPC ..... *G07F 11/42* (2013.01)

(58) Field of Classification Search
CPC ..... A47F 1/04
USPC ..... 221/125, 151, 152, 153, 226, 247, 250, 221/270, 279
See application file for complete search history.

(56) References Cited

U.S. PATENT DOCUMENTS

| | | | | | |
|---|---|---|---|---|---|
| 2,941,643 | A * | 6/1960 | Donnelly | 194/240 |
| 3,848,745 | A * | 11/1974 | Smith | 211/59.3 |
| 3,970,216 | A * | 7/1976 | Rainey | 221/125 |
| 4,729,481 | A * | 3/1988 | Hawkinson et al. | 211/59.3 |
| 4,830,201 | A * | 5/1989 | Breslow | 211/184 |
| 5,111,942 | A * | 5/1992 | Bernardin | 211/59.3 |
| 5,366,099 | A * | 11/1994 | Schmid | 211/59.3 |
| 5,873,489 | A * | 2/1999 | Ide et al. | 221/279 |
| 6,142,317 | A * | 11/2000 | Merl | 211/59.3 |
| 6,253,954 | B1 * | 7/2001 | Yasaka | 221/93 |
| 7,458,473 | B1 * | 12/2008 | Mason | 211/59.3 |
| 7,837,059 | B2 * | 11/2010 | Hieb et al. | 221/123 |
| 8,162,174 | B2 * | 4/2012 | Hieb et al. | 221/210 |

* cited by examiner

*Primary Examiner* — Patrick Mackey
(74) *Attorney, Agent, or Firm* — Novak Druce Connolly Bove + Quigg LLP

(57) ABSTRACT

A vending machine to dispense purchased goods includes a frame, a dispensing member, a controlling member, a blocking member and a driving member. The controlling member can slide a limiting shaft between a latched position and a releasing position. The driving member is a spring which is partly uncoiled and which constantly pulls the dispensing member, and thus a line of goods, towards the blocking member. When the limiting shaft is in the latched position, the limiting shaft prevents the blocking member rotating, so holding back the line of unpurchased goods. When the limiting shaft is retracted to the releasing position, the pressure of the line of goods rotates the blocking member through ninety degrees to allow one of the goods to pass out of the goods channel.

20 Claims, 8 Drawing Sheets

VENDING MACHINE WITH DISPENSING ASSEMBLY

BACKGROUND

1. Technical Field

The present disclosure relates to vending machines, and particularly to a vending machine with a simple dispensing assembly.

2. Description of Related Art

In many vending machines, the dispensing assembly includes rigid coils and motors. The motor rotates the coil causing products to be pushed along a channel to eventually drop into a bin accessible by a customer. Generally, each vending machine includes more than 6 partitions, each frame includes more than 8 channels, and each channel secures one dispensing assembly. Thus, more than 48 motors are used in one vending machine, which increase costs of the vending machine and causes more complexity in the assembly process of the dispensing assembly. Therefore, there is room for improvement in the art.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

Figure 1:
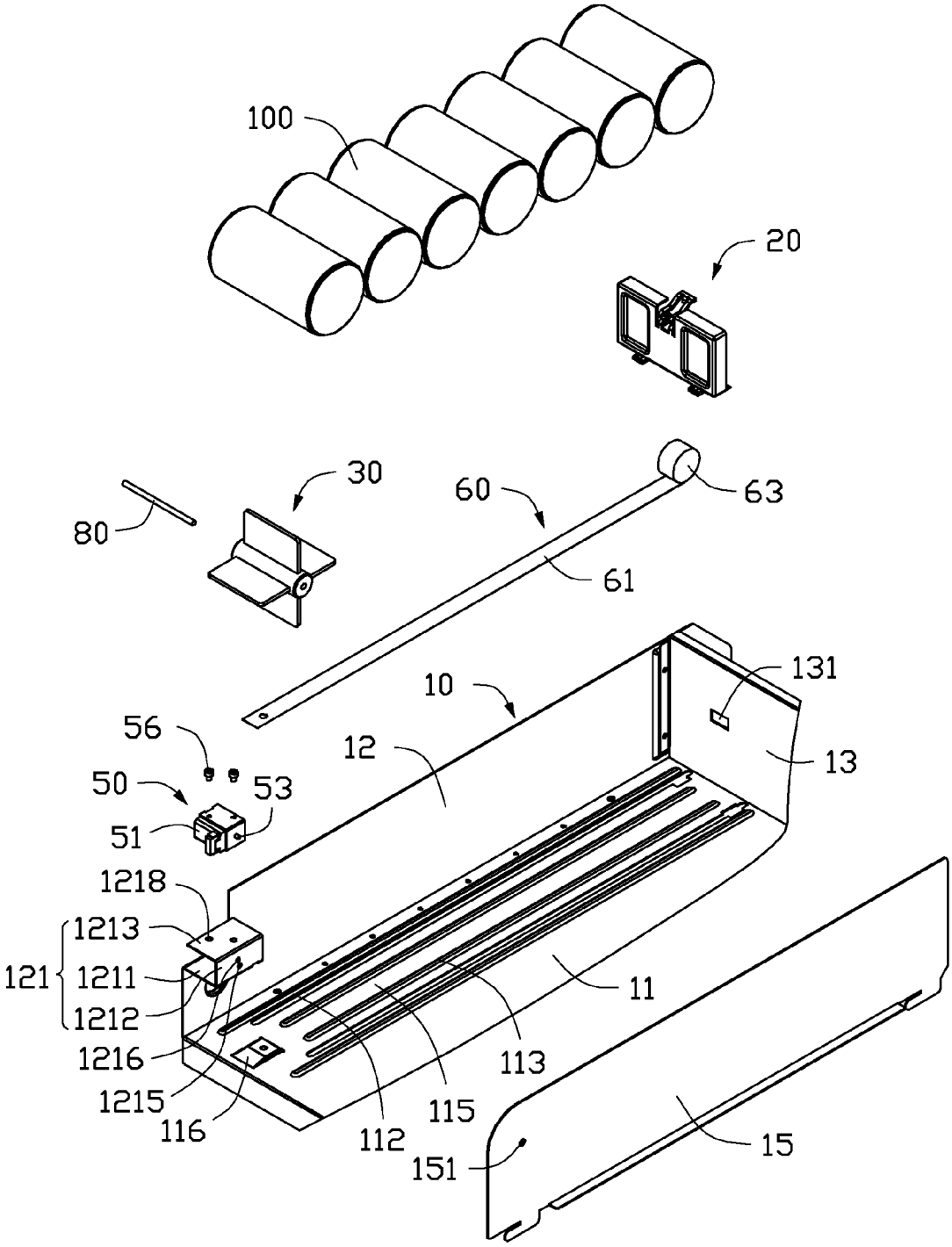
FIG. 1 is an exploded, isometric view of one embodiment of a vending machine.
Figure 2:
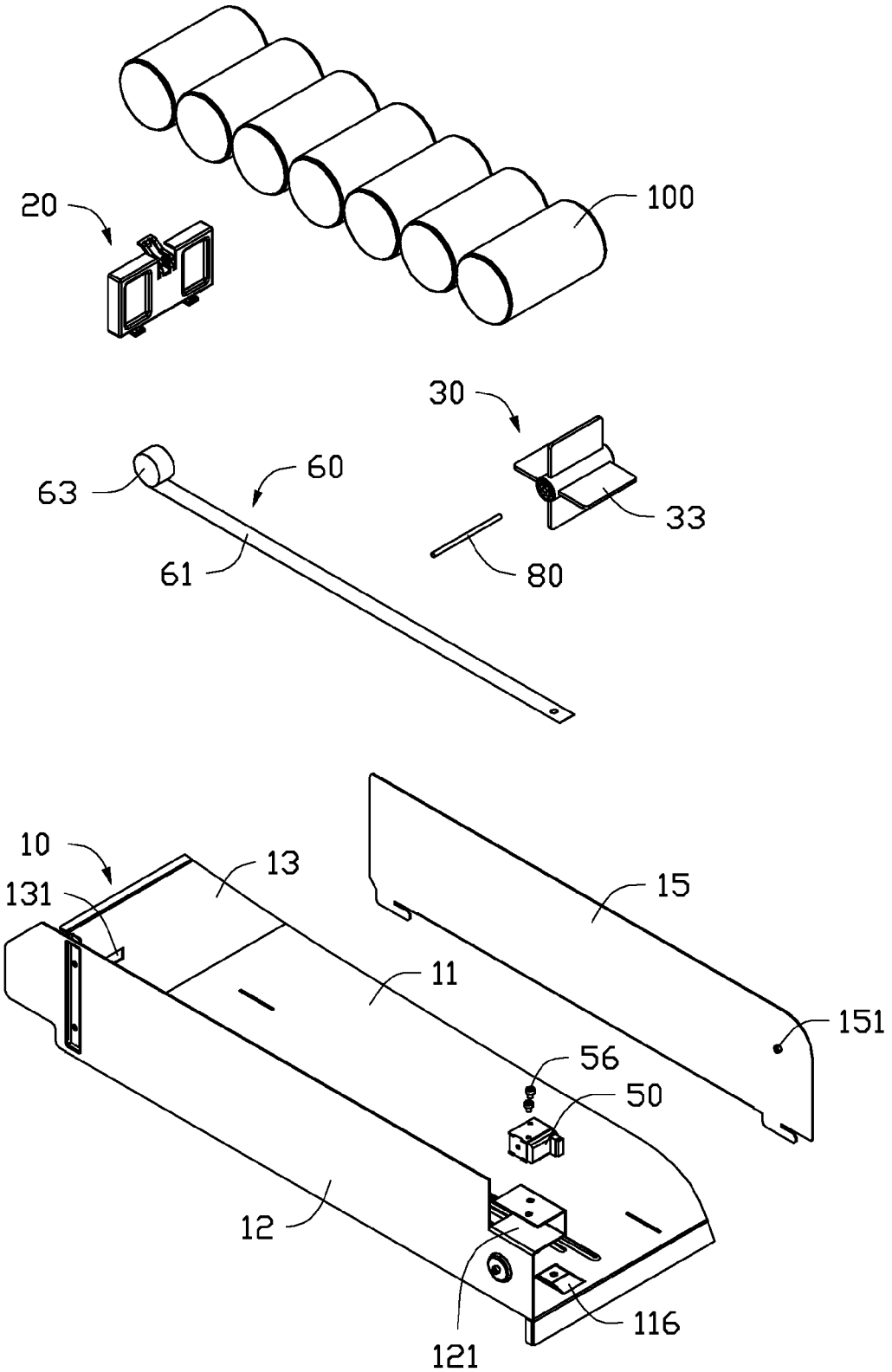
FIG. 2 is similar to FIG. 1, but viewed from a different aspect.

FIG. 1 and FIG. 2 show one embodiment of a vending machine. The vending machine includes a frame 10, a dispensing member 20, a blocking member 30, a controlling member 50, and a driving member 60.

Figure 5:
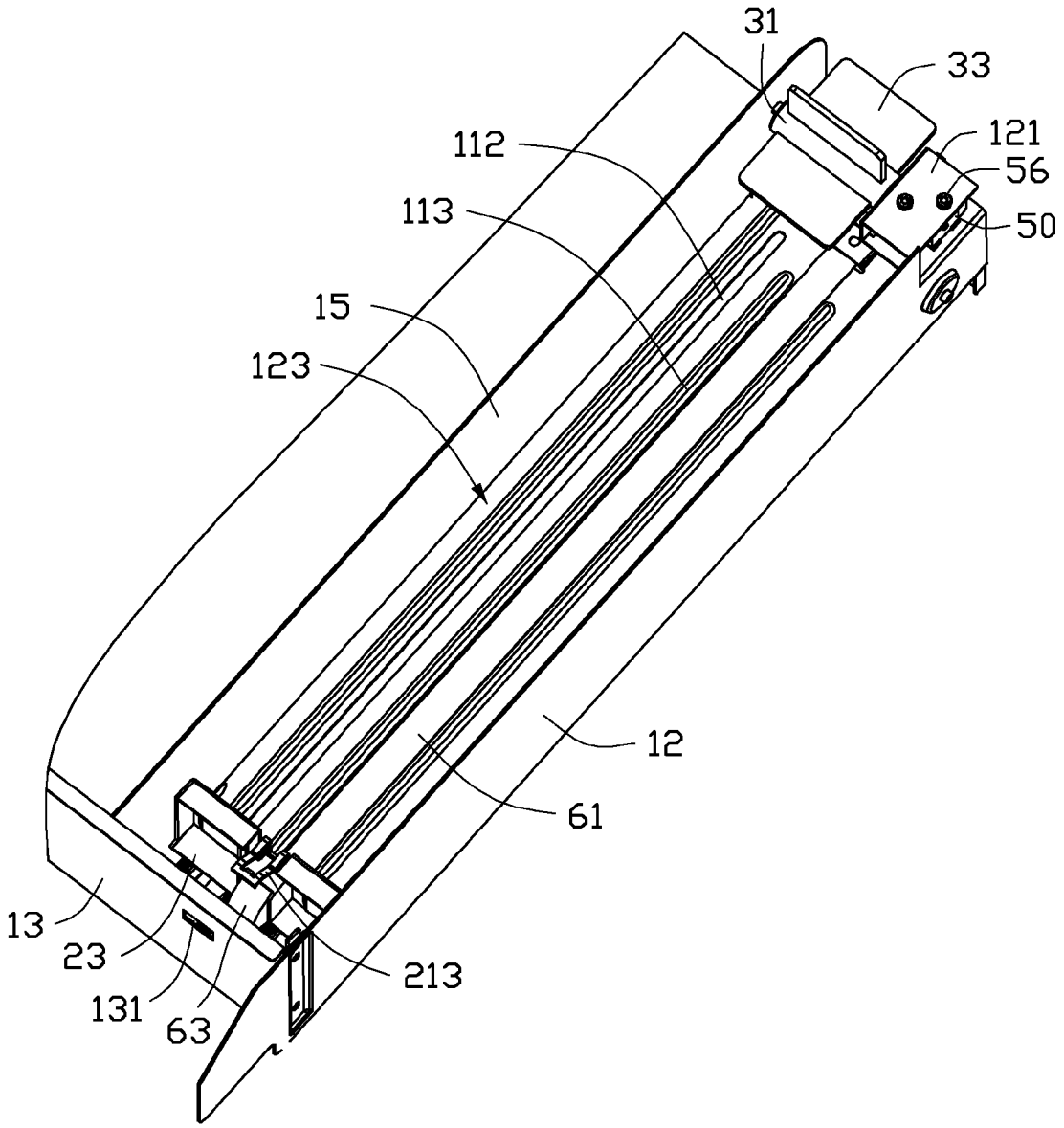
FIG. 5 is an assembled, isometric view of one embodiment of the vending machine of FIG. 1.
Figure 6:
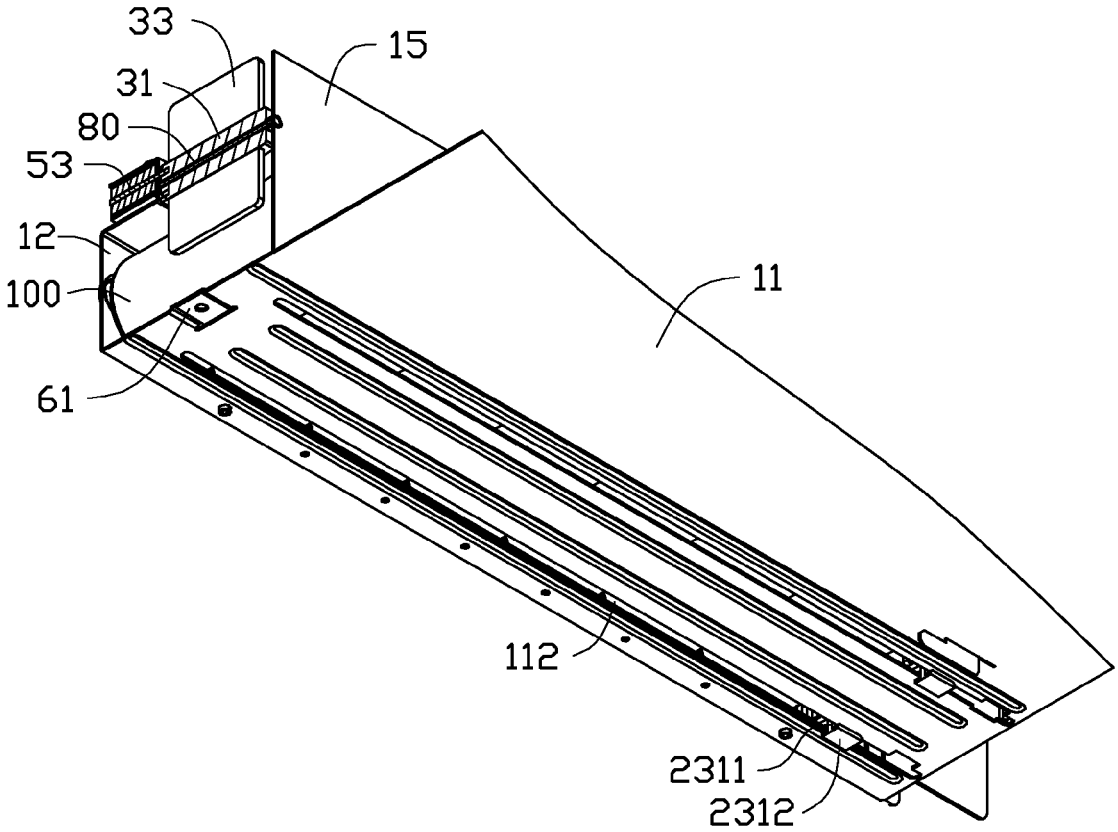
FIG. 6 is a cutaway view of the vending machine of FIG. 5.
Figure 7:
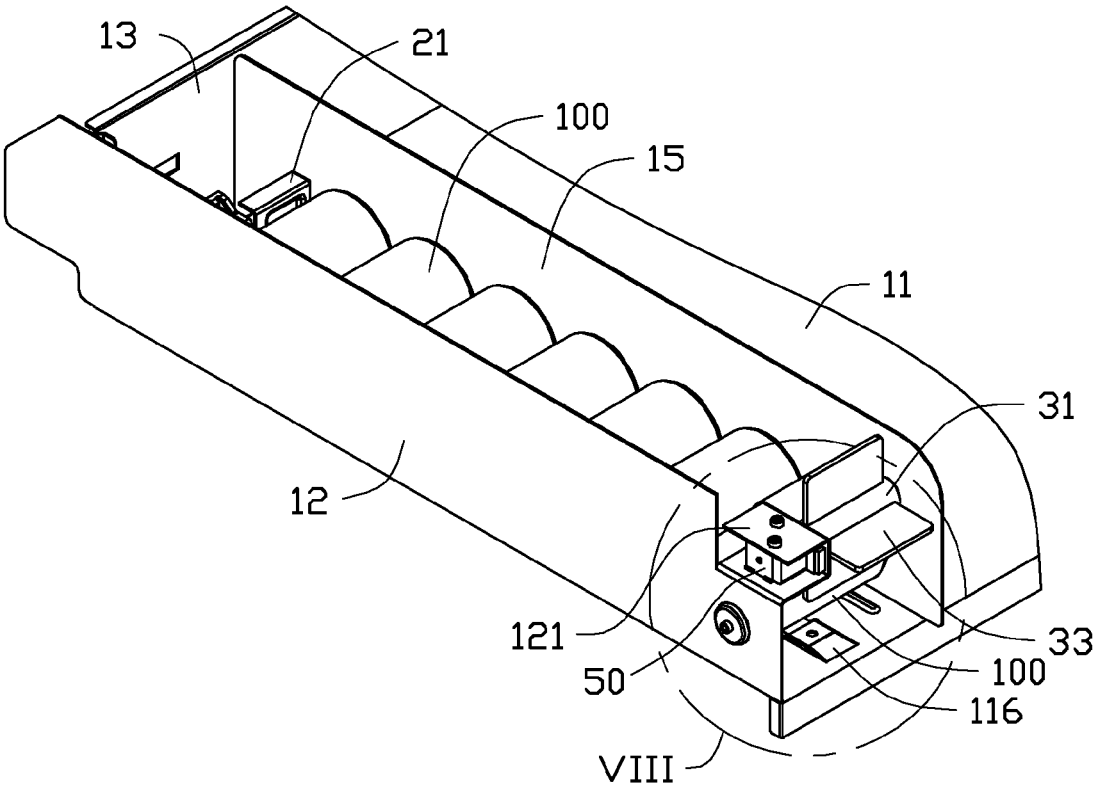
FIG. 7 is similar to FIG. 6, but viewed from a different aspect.
Figure 8:
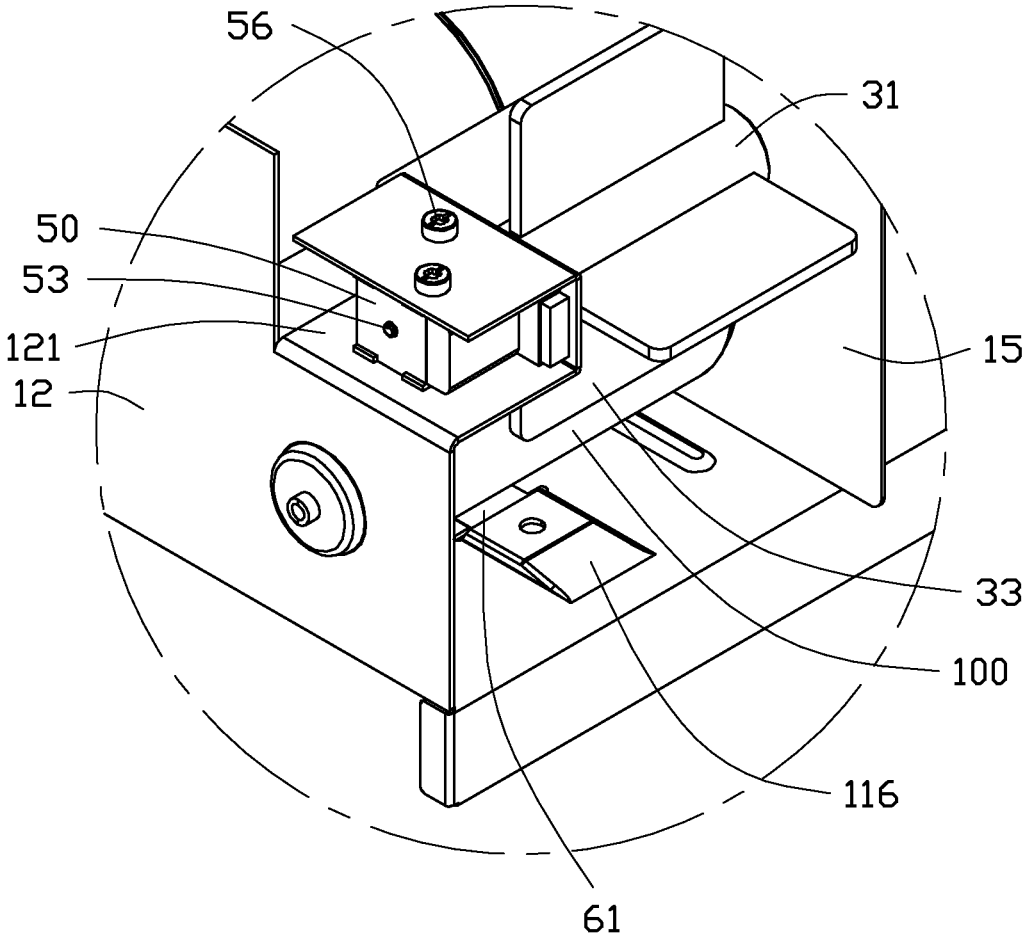
FIG. 8 is an enlarged view of a circled portion VIII of FIG. 7.

The frame 10 includes a bottom plate 11, a first dividing plate 12, a second dividing plate 15, and a rear plate 13 secured to the bottom plate 11. In one embodiment, the first dividing plate 12 is substantially parallel to the second dividing plates 15 and substantially perpendicular to the bottom plate 11, and the rear plate 13 is substantially perpendicular to each of the bottom plate 11, the first dividing plate 12, and the second dividing plate 15. The bottom plate 11 defines two sliding slots 112 (see FIG. 5), and two ribs 113 extending upwards from the bottom plate 11. The two ribs 113 are located between the two sliding slots 112. A receiving slot 115 is defined between the two ribs 113. A positioning piece 116 extends from the bottom plate 11. In one embodiment, the positioning piece 116 is substantially parallel to the bottom plate 11. A gap (not labeled) is defined between the positioning piece 116 and the bottom plate 11. A goods channel 123 (see FIG. 5) is defined between the first dividing plate 12 and the second dividing plate 15 in which a plurality of goods 100 may be placed.

An installation portion 121 extends from a side of the first dividing plate 12, which is away from the rear plate 13. The installation portion 121 includes a supporting plate 1211, a connecting plate 1212, and an installation plate 1213. In one embodiment, the supporting plate 1211 is substantially perpendicular to the first dividing plate 12, the connecting plate 1212 is substantially perpendicular to the supporting plate 1211 and parallel to the first dividing plate 12, and the installation plate 1213 is substantially parallel to the supporting plate 1211. The connecting plate 1212 defines a pivoting hole 1215 and a through hole 1216. The installation plate 1213 defines two installation holes 1218. The second dividing plate 15 defines a mounting hole 151 corresponding to the pivoting hole 1215. The rear plate 13 defines a latching hole 131. In one embodiment, the latching hole 131 is a rectangular opening.

Figure 3:
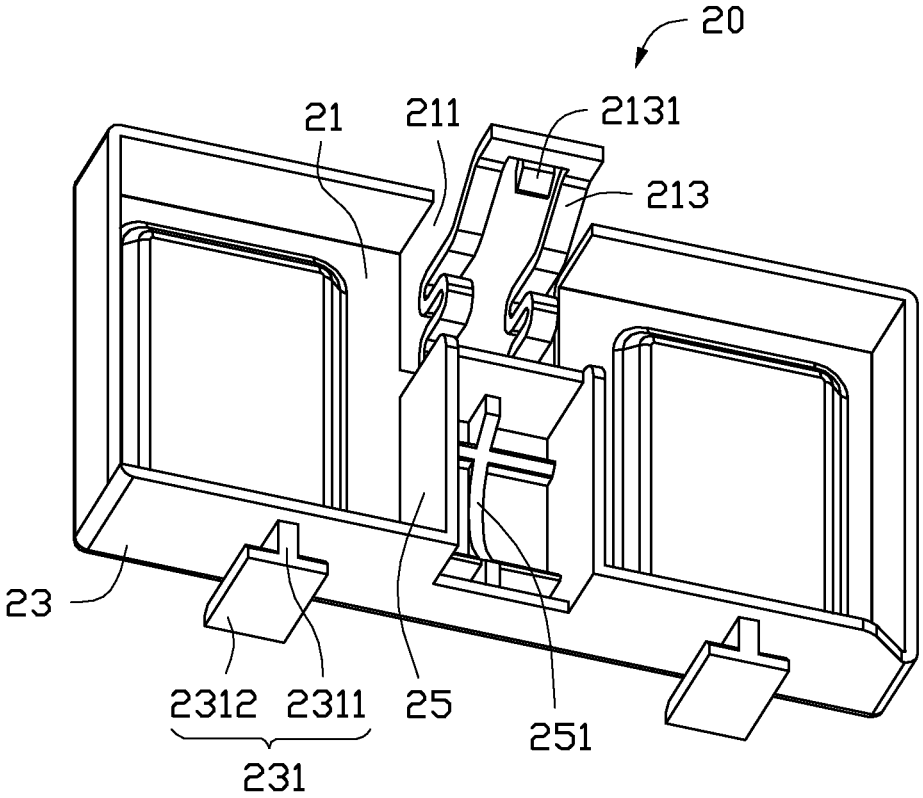
FIG. 3 is an isometric view of a dispensing member of the vending machine of FIG. 2.

FIG. 3 shows the dispensing member 20 including a dispensing plate 21 and a flange 23 extending from the dispensing plate 21. Two limiting portions 231 extend from a bottom surface of the flange 23. Each limiting portion 231 includes a sliding piece 2311 and a limiting piece 2312. The sliding piece 2311 is substantially perpendicular to the flange 23 and limiting piece 2312, and the limiting piece 2312 is substantially parallel to the flange 23. A receiving housing 25 is located in a corner between the dispensing plate 21 and the flange 23. The receiving housing 25 defines a receiving slot 251 for receiving a first end of the driving member 60. The dispensing plate 21 further defines a cutout 211. A latching portion 213 extends from a bottom edge of the cutout 211 and includes a latching piece 2131. The latching portion 213 is elastically deformable to enable insertion through the latching hole 131 to engage the latching piece 2131 with the rear plate 13.

Figure 4:
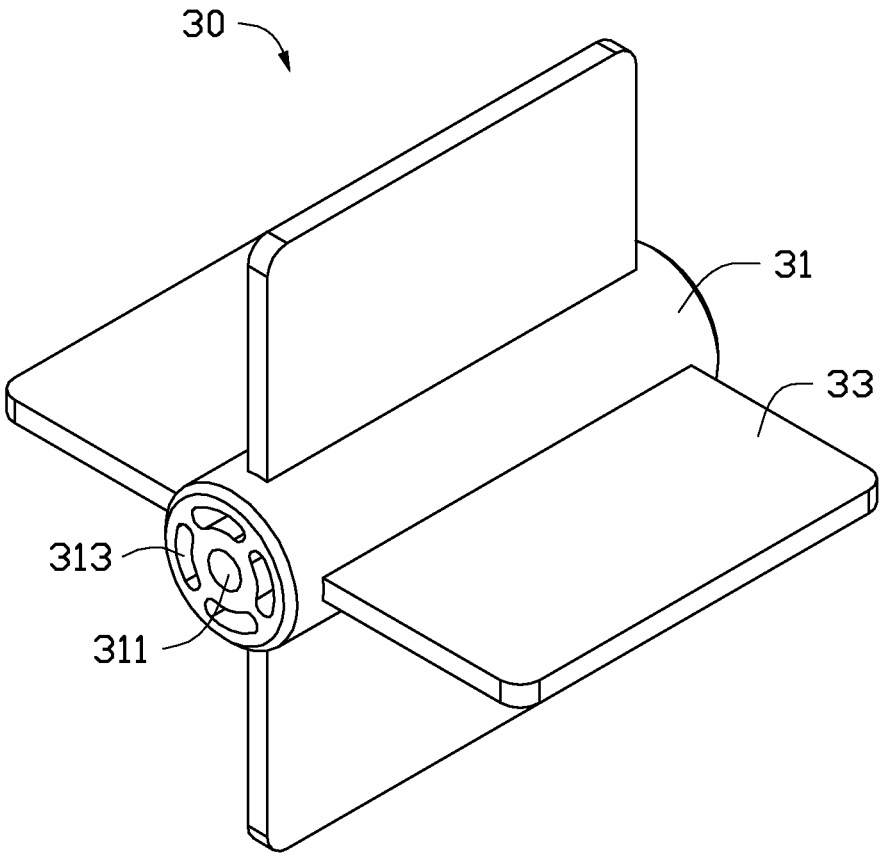
FIG. 4 is an isometric view of a blocking member of the vending machine of FIG. 2.

FIG. 4 shows that the blocking member 30 includes a rotating portion 31 and four blocking plates 33 located on an outer surface of the rotating portion 31. The rotating portion 31 defines a through hole 311 and four latching slots 313 in a side surface of the rotating portion 31. The through hole 311 extends through two side surfaces of the rotating portion 31. Each two adjacent blocking plates 33 are substantially perpendicular to each other. Each latching slot 313 is curved. The four latching slot 313 together form a circle.

The controlling member 50 includes a controller 51 and a limiting shaft 53 slidably mounted in the controller 51. The controller 51 controls the limiting shaft 53 to slide between a latching position and a releasing position when a pulse signal is received. When the limiting shaft 53 is in the latching position, the limiting shaft 53 extends out of the controller 51 for being received in one of the latching slots 313. When the limiting shaft 53 is in the releasing position, the limiting shaft 53 goes back to the controller 51 and is disengaged from the latching slot 313. In one embodiment, the controlling member 50 is a solenoid valve.

The driving member 60 includes a coiled portion 63, and a straight portion 61, the straight portion 61 being part of the coiled portion 63 but pulled out flat. In one embodiment, the driving member 60 is a spring.

FIGS. 5-8 show that, in assembly, the first dividing plate 12 and the second dividing plate 15 are secured to the bottom plate 12 by screws. The controlling member 50 is received in the installation portion 121 and secured to the installation plate 1213 through the installation hole 1218 by two screws 56. A mounting shaft 80 extends through the through hole 311. A first end of the mounting shaft 80 is engaged in the pivoting hole 1215. A second end of the mounting shaft 80 is engaged in the mounting hole 151. Thus, the blocking member 30 is rotatable about the mounting shaft 80. The dispensing member 20 is oblique relative to the bottom plate 11 and the limiting portion 231 is inserted into the sliding slot 112 adjacent to the rear plate 13. The dispensing member 20 is placed horizontally, the sliding piece 2311 is slidably received in the sliding slot 112, and the bottom plate 11 is located between the limiting piece 2312 and the flange 23 to prevent the dispensing member 20 disengaging from the sliding slot 112. A distal end of the straight portion 61 is inserted through the gap between the bottom plate 11 and the positioning piece 116 and secured to the positioning piece 116. The coiled portion 63 is engaged in the receiving slot 251. A plurality of goods 100 is placed between the dispensing member 20 and the blocking member 30.

When the goods 100 are in place but unpurchased, the dispensing member 20 exerts a pushing force, towards the blocking member 30, on the goods 100 under the action of the coiled portion 63. The pushing force pushes the goods 100 out of the goods channel 123. The limiting shaft 53 is located in the latching position and engaged in the latching slot 313 to prevent the blocking member 30 from rotating. One of the blocking plates 33 is substantially perpendicular to the bottom plate 11 and resists the goods 100. The one blocking plate 33 exerts a blocking force towards the dispensing member 20.

When one of the goods 100 is purchased, a pulse signal generator (not shown) sends a signal to the controlling member 50 to move the limiting shaft 53 to the releasing position. In this position, the blocking member 30 is rotatable about the rotating shaft 80 in the manner of a turnstile, and the equilibrium of the goods is broken. The coiled portion 63 rolls up a part of the straight portion 61, towards the blocking member 30, causing the dispensing member 20 to move towards the blocking member 30 and thus push the goods 100 towards the blocking member 30. The blocking member 30 is rotated about the mounting shaft 30 under the pushing action of the goods 100, until one of the goods 100 is pushed out of the goods channel 123. The blocking member 30 is by then rotated 90 degrees. The pulse signal generator sends another signal to the controlling member 50 to move the limiting shaft 53 to the latching position to block the blocking member 30. The goods 100 unpurchased and remained are then in the standstill state again.

It is to be understood, however, that even though numerous characteristics and advantages have been set forth in the foregoing description of embodiments, together with details of the structures and functions of the embodiments, the disclosure is illustrative only and changes may be made in detail, especially in the matters of shape, size, and the arrangement of parts within the principles of the disclosure, to the full extent indicated by the broad general meaning of the terms in which the appended claims are expressed.

What is claimed is:

1. A vending machine, comprising:

a frame comprising a bottom plate, a first dividing plate and a second dividing plate secured to the bottom plate; and a goods channel defined between the first dividing plate and the second dividing plate;

a dispensing member slidably mounted to the bottom plate and is slidable relative to the chassis to push the goods out of the goods channel;

a controlling member secured to the first dividing plate and comprising a controller and a limiting shaft; and a blocking member rotatably mounted between the first dividing plate and the second dividing plate and defines a latching slot;

wherein the controller is operable to slide the limiting shaft between a first latching position and a released portion; when the limiting shaft is in the latching position, the limiting shaft is engaged in the latching slot, and the blocking member blocks the goods to prevent the goods from being pushed out of the goods channel; and when the limiting shaft is in the released position, the limiting shaft is disengaged from the latching slot, and the blocking member is rotatable relative to the frame, allowing the dispensing member to push the goods out of the goods channel.

2. The vending machine of claim 1, further comprising a driving member, wherein a first end of the driving member is secured to the bottom plate, and a second end of the driving member, opposite to the first end of the driving member, is rollably mounted to the dispensing member.

3. The vending machine of claim 2, wherein when the limiting shaft is in the released position, the second end of the driving member is rolled up towards the blocking member with the dispensing member, causing the goods be moved out of the goods channel.

4. The vending machine of claim 1, wherein the dispensing member comprising a pushing plate and a flange extending from the pushing plate, and a limiting portion located in the flange; the bottom plate defines a sliding slot; the limiting portion comprises a sliding piece and a limiting piece connected to the sliding piece, the limiting piece is engaged with a bottom surface of the bottom plate through the sliding slot, and sliding piece is slidably received in the sliding slot.

5. The vending machine of claim 4, wherein the blocking member comprises a rotating portion and at least one blocking plate located on the rotating portion; and when the limiting shaft is in the latching portion, the at least one blocking plate is substantially perpendicular to the bottom plate.

6. The vending machine of claim 5, wherein when the limiting shaft is moved from the latching position to the released position, the blocking member is rotated 90 degrees.

7. The vending machine of claim 5, further comprising a mounting shaft, wherein a first end of the mounting shaft is secured to the first dividing plate, and a second end of the mounting shaft, opposite to the first end of the mounting shaft, is secured to the second dividing plate through the rotating portion.

8. The vending machine of claim 7, wherein when the first dividing plate defines an installation portion, which defines a through hole, and the controlling member is received in the installation portion; and when the limiting shaft is in the latching position, the mounting shaft is engaged in the latching slot through the through hole.

9. The vending machine of claim 5, wherein the at least one blocking plate comprises four blocking plates, and each adjacent two of the four blocking plates are substantially perpendicular to each other.

10. The vending machine of claim 1, wherein the latching slot is curved.

11. A vending machine, comprising:

a frame comprising a bottom plate, a first dividing plate and a second dividing plate secured to the bottom plate; and a goods channel defined between the first dividing plate and the second dividing plate;

a dispensing member slidably mounted to the bottom plate and is slidable relative to the chassis to push the goods out of the goods channel;

a controlling member secured to the first dividing plate and comprising a controller and a limiting shaft;

a blocking member rotatably mounted between the first dividing plate and the second dividing plate and defines a latching slot; and a driving member rollably mounted to the bottom plate and the dispensing member;

wherein the controller is operable to slide the limiting shaft between a first latching position and a released portion; when the limiting shaft is in the latching position, the limiting shaft is engaged in the latching slot, and the blocking member blocks the goods to prevent the goods from being pushed out of the goods channel; and when the limiting shaft is in the released position, the limiting shaft is disengaged from the latching slot, the blocking member is rotatable relative to the frame, and the driving member is rolled up to push the dispensing member to push the goods out of the goods channel.

12. The vending machine of claim 11, wherein a first end of the driving member is secured to the bottom plate, and a second end of the driving member, opposite to the first end of the driving member, is rollably mounted to the dispensing member.

13. The vending machine of claim 12, wherein when the limiting shaft is in the released position, the second end of the driving member is rolled up towards the blocking member with the dispensing member, causing the goods be moved out of the goods channel.

14. The vending machine of claim 11, wherein the dispensing member comprising a pushing plate and a flange extending from the pushing plate, and a limiting portion located in the flange; the bottom plate defines a sliding slot; the limiting portion comprises a sliding piece and a limiting piece connected to the sliding piece, the limiting piece is engaged with a bottom surface of the bottom plate through the sliding slot, and sliding piece is slidably received in the sliding slot.

15. The vending machine of claim 14, wherein the blocking member comprises a rotating portion and at least one blocking plate located on the rotating portion; and when the limiting shaft is in the latching portion, the at least one blocking plate is substantially perpendicular to the bottom plate.

16. The vending machine of claim 15, wherein when the limiting shaft is moved from the latching position to the released position, the blocking member is rotated 90 degrees.

17. The vending machine of claim 15, further comprising a mounting shaft, wherein a first end of the mounting shaft is secured to the first dividing plate, and a second end of the mounting shaft, opposite to the first end of the mounting shaft, is secured to the second dividing plate through the rotating portion.

18. The vending machine of claim 17, wherein when the first dividing plate defines an installation portion, which defines a through hole, and the controlling member is received in the installation portion; and when the limiting shaft is in the latching position, the mounting shaft is engaged in the latching slot through the through hole.

19. The vending machine of claim 15, wherein the at least one blocking plate comprises four blocking plates, and each adjacent two of the four blocking plates are substantially perpendicular to each other.

20. The vending machine of claim 11, wherein the latching slot is curved.

* * * * *